US006077658A

United States Patent [19]

Lussier et al.

[11] Patent Number: 6,077,658

[45] Date of Patent: Jun. 20, 2000

[54] SILVER HALIDE ELEMENTS CONTAINING YELLOW COUPLERS WITH IMPROVED DYE STABILITY

[75] Inventors: Barbara B. Lussier, Rochester; Michael J. Proseus, Webster, both of N.Y.

[73] Assignee: Eastman Kodak Company, Rochester, N.Y.

[21] Appl. No.: 09/216,777

[22] Filed: Dec. 18, 1998

[51] Int. Cl.[7] ..... G03C 1/00; G03C 7/26; G03C 7/32

[52] U.S. Cl. ..... 430/557; 430/556; 430/551

[58] Field of Search ..... 430/556, 557, 430/543, 551

[56] References Cited

U.S. PATENT DOCUMENTS

| | | | |
|---|---|---|---|
| 4,207,111 | 6/1980 | Fujiwhara et al. | 430/376 |
| 4,248,962 | 2/1981 | Lau | 430/382 |
| 4,356,258 | 10/1982 | Usui et al. | 430/557 |
| 4,758,501 | 7/1988 | Buckland et al. | 430/389 |
| 4,914,013 | 4/1990 | Ikesu et al. | 430/555 |
| 4,978,605 | 12/1990 | Tsoi | 430/557 |
| 5,053,325 | 10/1991 | Masukawa | 430/557 |
| 5,118,599 | 6/1992 | Lau et al. | 430/556 |
| 5,273,869 | 12/1993 | Tanaka et al. | 430/505 |
| 5,336,591 | 8/1994 | Yamamoto et al. | 430/549 |
| 5,336,592 | 8/1994 | Chino et al. | 430/557 |

FOREIGN PATENT DOCUMENTS

| | | |
|---|---|---|
| 0 570 006 | 11/1993 | European Pat. Off. . |
| 0 600 561 | 8/1994 | European Pat. Off. . |
| 3209710 | 2/1983 | Germany . |
| 4240000 | 6/1994 | Germany . |

*Primary Examiner*—Geraldine Letscher
*Attorney, Agent, or Firm*—Sarah Meeks Roberts

[57] ABSTRACT

This invention relates to a photographic element comprising a silver halide emulsion layer having associated therewith a yellow dye-forming coupler which is an acylacetanilide compound comprising an alkoxy or aryloxy substituent ortho to the nitrogen atom on the acetanilide ring said ring further comprising a substituent containing a chroman ether group.

31 Claims, No Drawings

SILVER HALIDE ELEMENTS CONTAINING YELLOW COUPLERS WITH IMPROVED DYE STABILITY

FIELD OF THE INVENTION

This invention relates to color photographic materials or elements comprising a yellow dye-forming coupler which forms a dye upon development which exhibits improved stability against dye fade.

BACKGROUND OF THE INVENTION

A typical photographic element contains multiple layers of light-sensitive photographic silver halide emulsions with one or more of these layers being spectrally sensitized to blue light, green light, and red light, respectively. The blue, green, and red light sensitive layers will typically contain yellow, magenta or cyan dye forming couplers, respectively.

For forming color photographic images, the color photographic material is exposed imagewise and processed in a color developer bath containing an aromatic primary amine color developing agent. Image dyes are formed by the coupling reaction of these couplers with the oxidized product of the color developing agent. Generally, image couplers are selected to provide image dyes with good stability towards heat and light and which desirably have an absorption curve with a suitable peak absorption and low unwanted side absorptions in order to provide color photographic images with good color reproduction.

The present invention is concerned with improving the light stability of yellow image dyes. Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Other examples of yellow dye-forming couplers are detailed in *Research Disclosure* No. 365, Item 36544, September 1994, Section X-B(6). Such couplers are typically open chain ketomethylene compounds.

The ability of yellow image dyes to resist fade is important to the longevity of color images, especially those which are destined to be subject to prolonged storage or constant daylight exposure such as professional portraits and the like. Yellow images will fade and images formed with yellow dye as a component may change color if the rate of fade for the yellow dye is not sufficiently matched with the other dyes of the photographic element.

Heretofore, one method of improving the light stability of yellow image dyes has been to add one or more stabilizing addenda to the coupler dispersion. Compounds suitable for this purpose are described more fully in *Research Disclosure* No. 365, Item 36544, September 1994, Section X-D. However, stabilizing addenda can create adverse sensitometric affects. Furthermore, every addenda which must be added to an emulsion layer increases the cost of the product and creates additional manufacturing steps. U.S. Pat. No. 4,207,111 relates to couplers containing ortho chloro anilide and aryl ether substituents which are stated to provide light fastness.

There is still a need, however, for a yellow image dye-forming coupler which forms a dye upon development which exhibits improved light stability and desirable hue. It is particularly desirable to provide such a dye which requires little or no stabilizing addenda.

SUMMARY OF THE INVENTION

This invention provides a photographic element comprising a silver halide emulsion layer having associated therewith a yellow dye-forming coupler which is an acylacetanilide compound comprising an alkoxy or aryloxy substituent ortho to the nitrogen atom on the acetanilide ring, said ring further comprising a substituent containing a chroman ether group.

The couplers utilized in the photographic elements of this invention have improved long-term stability of the yellow dyes formed during processing. The quantity of light stabilizing addenda which must be utilized in the photographic element is significantly reduced, or in some cases eliminated. The couplers utilized are highly active and have a desirable hue. The starting materials for manufacturing the couplers are readily available.

DETAILED DESCRIPTION OF THE INVENTION

The coupler utilized in the photographic elements of this invention is a yellow dye-forming coupler which is an acylacetanilide compound comprising an alkoxy or aryloxy substituent ortho to the nitrogen atom on the acetanilide ring, said ring further comprising a substituent containing a chroman ether group. The combination of the alkoxy or aryloxy substituent and the chroman ether containing substituent provide a coupler which has superior light stability and desirable hue. Preferably the substituent ortho to the nitrogen atom and the substituent containing the chroman ether group comprise at least one branched alkyl group, more preferable at least two branched alkyl groups and most preferably at least three branched alkyl groups. These groups are preferably branched at the alpha carbon and form tertiary or quartemary carbons. In one embodiment the coupler is represented by the following formula:

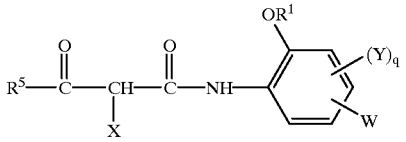

Y is any substituent which does not interfere with the desired activity of the coupler. Preferable Y is a halogen or an alkoxy group and q is 0 or 1. X is hydrogen or a coupling-off group which can be split from the coupler upon reaction with oxidized developer. The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK Patents and published application Nos. 1,466,728, 1,531,927, 1,533,039, 2,006, 755A and 2,017,704A, the disclosures of which are incorporated herein by reference. Preferred coupling off groups are N-heterocycles and alkoxy groups.

$R^5$ is a substituent which does not interfere with the desired activity of the compound. Preferably $R^5$ is an alkyl, aryl or heterocyclic group or a dialkylamino group. More preferably $R^5$ is an alkyl group having 1 to 20 carbon atoms and most preferably 1 to 10 carbon atoms. In one suitable embodiment the alkyl group is branched, preferably at the alpha carbon. Suitable groups include, for example, isopropyl, t-butyl, t-pentyl, t-octyl, methylcyclopropyl, or adamantyl groups. In one preferred embodiment $R^5$ is an adamantyl group. The adamantyl group at this position has been found to improve light stability even further. When $R^5$ is an aryl group it preferably has 6 to 10 carbon atoms. Examples of preferred aryl groups include phenyl and naphthol groups with phenyl groups being more preferred.

$R^1$ is an alkyl or aryl group. Preferably $R^1$ is an alkyl group having 1 to 20 carbon atoms and more preferably 1 to 10 carbon atoms. In one suitable embodiment the alkyl group is branched, preferably at the alpha carbon. Suitable groups include, for example, isopropyl, t-butyl, t-pentyl, t-octyl, methylcyclopropyl, or adamantyl groups. When $R^1$ is an aryl group it preferably has 6 to 10 carbon atoms. Examples of preferred aryl groups include phenyl and naphthol groups with phenyl groups being more preferred. It is most preferred that $R^1$ be a branched alkyl group having 1 to 10 carbons.

W is a substituent containing a chroman ether group. Preferably the chroman ether group contains a substituent on the phenyl ring and more preferably the substituent on the phenyl ring of the chroman ether group is an alkyl group branched at the alpha carbon of the substituent. In one suitable embodiment W has the formula:

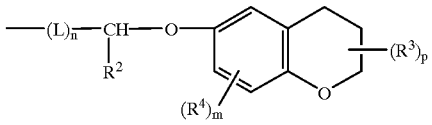

wherein $R_2$ is hydrogen or a substituent, $R^4$ is a substituent with m being 0 to 3, $R^3$ is alkyl, aryl, or hydrogen, with p being 0 to 3, and L is a divalent linking group with n being 0 to 3.

The group L is optionally present. As indicated by the value of q of up to three, there may be present as many as three L groups. Each of the L groups may be independently selected to provide the linkage. In the broadest sense, L may be any divalent group linking the chroman ether group to the acetanilide ring. Each L may be represented, for example, by one of the groups:

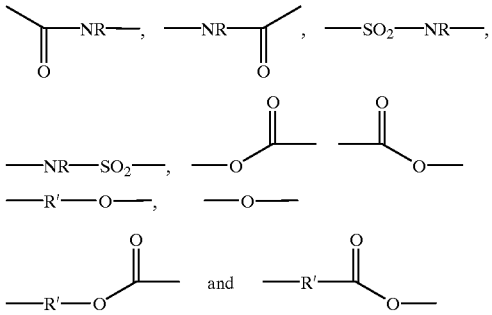

wherein R is hydrogen or an alkyl group and R' is an alkylene group. Specifically useful are:

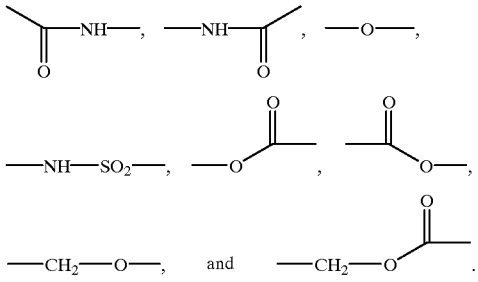

Some particularly suitable L groups are aminocarbonyl, acylamino, acyloxy, or oxycarbonyl groups.

While $R^2$ may be any substituent which does not interfere with the desired activity of the coupler, $R^2$ is preferably an alkyl, alkoxy or aryl group. More preferably $R^2$ is an alkyl group having 1 to 20 carbon atoms and more preferably 1 to 12 carbon atoms. When $R^2$ is an aryl group it preferably has 6 to 10 carbon atoms. Examples of preferred aryl groups include phenyl and naphthol groups with phenyl groups being more preferred.

$R^4$ may also be any substituent which does not interfere with the desired activity of the coupler, however preferably $R^4$ is an alkyl, alkoxy, dialkylamino or alkylthio group. More preferably $R^4$ is an alkyl group having 1 to 20 carbon atoms and most preferably 1 to 10 carbon atoms. In one suitable embodiment the alkyl group is branched, preferably at the alpha carbon. Suitable groups include, for example, isopropyl, t-butyl, t-pentyl, t-octyl, methylcyclopropyl, or adamantyl groups.

In one embodiment the yellow dye-forming coupler is represented by the following formula

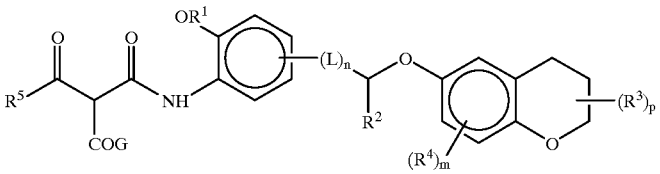

wherein L, X, $R^1$, $R^2$, $R^3$, $R^4$, and $R^5$ are as defined above and wherein at least one of $R^1$, $R^3$ and $R^4$ is an alkyl group branched at the alpha carbon. More preferably at least two of $R^1$, $R^3$ and $R^4$ is an alkyl group branched at the alpha carbon. Preferably the alkyl groups are branched to form tertiary or quarternary carbons. In one embodiment $R^1$, $R^2$, $R^3$, and $R^4$ are independently alkyl groups, preferably alkyl group having 1 to 10 carbon atoms and $R^5$ is an alkyl or aryl group.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The yellow couplers utilized in this invention may utilized in association with silver halide emulsions containing less than 0.5 moles of coupler stabilizing addenda per mole of coupler, and more preferably less than 0.3 moles of coupler stabilizing addenda per mole of coupler. Most preferably no coupler stabilizing addenda is utilized.

Although one major advantage of the couplers utilized in this invention is that no additional light stabilizing compounds are needed, neutral fade can also be achieved even if extremely stable magenta and cyan dyes are utilized by incorporating coupler stabilizing addenda along with the yellow couplers of this invention. The addenda typically used are hose exemplified by Compounds 1–3 but are not limited to these. Also suitable are polymeric stabilizing addenda. The polymers can be homopolymers or copolymers which are miscible with the coupler and coupler solvent which are present, for example, as a latex or as an organic solution. Especially useful are polymers containing monomers derived from styrene and/or acrylics such as acrylamide (particularly t-butyl acrylamide such as P-1 below where x=99 and y=1), acrylates, methacrylamides and methacrylates Compound 1

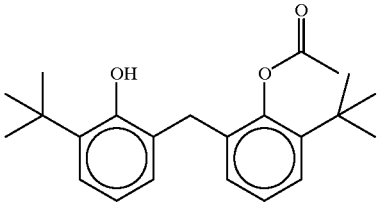

Compound 2

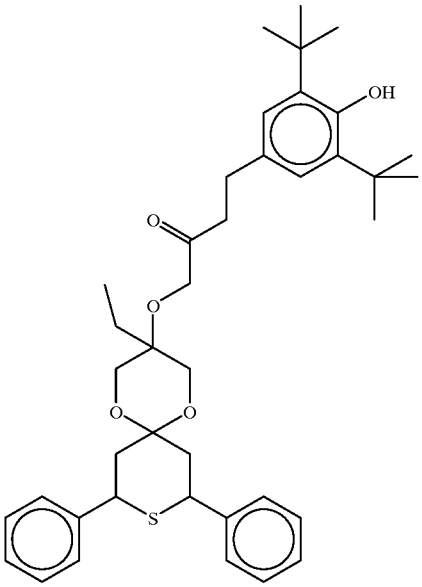

Compound 3

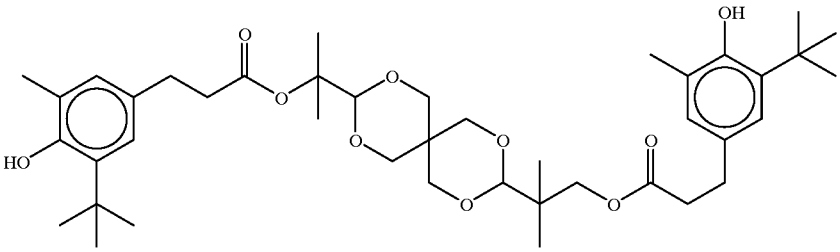

P1

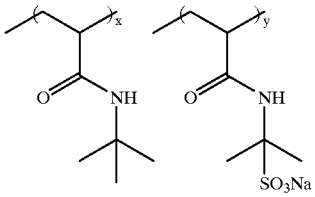

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire PO10 7DQ, ENGLAND, the contents of which are incorporated herein by reference. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure*, June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) *Research Disclosure*, December 1978, Item 17643, (2) *Research Disclosure*, December 1989, Item 308119, (3) *Research Disclosure*, September 1994, Item 36544, and (4) *Research Disclosure*, September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure*, February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, | morphology and |
| 3 & 4 | XI, XII, | preparation. Emulsion |
| | XIV, XV | preparation including |
| | I, II, III, IX | hardeners, coating aids, |
| | A & B | addenda, etc. |
| 1 | III, IV | Chemical sensitization and |
| 2 | III, IV | spectral sensitization/ |
| 3 & 4 | IV, V | desensitization |
| 1 | V | UV dyes, optical |

-continued

| Reference | Section | Subject Matter |
|---|---|---|
| 2 | V | brighteners, luminescent |
| 3 & 4 | VI | dyes |
| 1 | VI | Antifoggants and |
| 2 | VI | stabilizers |
| 3 & 4 | VII | |
| 1 | VIII | Absorbing and scattering |
| 2 | VIII, XIII, | materials; Antistatic layers; |
| 3 & 4 | XVI | matting agents |
| | VIII, IX C | |
| | & D | |
| 1 | VII | Image-couplers and image- |
| 2 | VII | modifying couplers; Wash- |
| 3 & 4 | X | out couplers; Dye |
| | | stabilizers and hue |
| | | modifiers |
| 1 | XVII | Supports |
| 2 | XVII | |
| 3 & 4 | XV | |
| 3 & 4 | XI | Specific layer arrangements |
| 3 & 4 | XII, XIII | Negative working |
| | | emulsions; Direct positive |
| | | emulsions |
| 2 | XVIII | Exposure |
| 3 & 4 | XVI | |
| 1 | XIX, XX | Chemical processing; |
| 2 | XIX, XX, | Developing agents |
| 3 & 4 | XXII | |
| | XVIII, XIX, | |
| | XX | |
| 3 & 4 | XIV | Scanning and digital |
| | | processing procedures |

The photographic elements can be incorporated into exposure structures intended for repeated use or exposure structures intended for limited use, variously referred to as single use cameras, lens with film, or photosensitive material package units.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, heteroxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58–172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613. Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire PO101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

The silver halide emulsions utilized may be of any silver halide composition, including but not limited to silver bromide, silver bromoiodide, silver chloride, silver chlorobromide, and silver chloroiode. Preferably the silver halide emulsions utilized in this invention are greater than 50 mole % silver chloride. More preferably the emulsions are greater than 90 mole % silver chloride and most preferably greater than 95 mole % silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred, with cubic being particularly useful The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198. Where applicable, the element may be processed in accordance with color print processes such as the RA-4 process of Eastman Kodak Company as described in the British Journal of Photography Annual of 1988, Pp 198–199. Such negative working emulsions are typically sold with instructions to process using a color negative method such as the mentioned C-41 or RA-4 process. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The following examples are intended to illustrate, but not to limit the invention.

EXAMPLES

Preparative Examples

Preparation of Intermediate I: Ethyl-[a(2,2,4-trimethyl-7-tert-octyl-6-chromanoxy)octanoate].

Sodium hydride (8.4 g, 0.35 mol) was added to a solution of 2,2,4-trimethyl-7-tert-octyl-6-chromanol (106.6 g, 0.35 mol) in dry N,N-dimethylformamide (150 mL). The solution was allowed to stir at room temperature under nitrogen for 16 hours, then heated to 50° C. for 30 minutes. Ethyl-2-bromooctanoate (87.9 g, 0.35 mol) was added dropwise and the reaction mixture stirred at 50° C. for 5 hours. The reaction mixture was cooled, added to 300 mL of water, and extracted with ethyl acetate (3×100 mL). The organic extracts were washed with water until the aqueous washes were of neutral pH, then dried over magnesium sulfate. The solvent was removed in vacuo to yield 142.5 g of the product as an amber oil.

Preparation of Intermediate II: [a(2,2,4-trimethyl-7-tert-octyl-6-chromanoxy)octanoic acid].

The crude ethyl ester (142.5 g, 0.3 mol) prepared above, was dissolved in 1:1 methanol/THF (400 mL)and stirred at room temperature. To this solution was added 6 N potassium hydroxide (150 mL, 0.9 mol). The reaction was heated to reflux for 16 hours. The reaction was cooled to room temperature, neutralized with 3N HCl and extracted with EtOAc. The organic solvents were removed in vacuo to yield 136.5 g of brown oil. The oil was flash chromatographed on silica using 95:5 ligroin/ethyl acetate as the eluent to yield 115.68 g of the product as a highly viscous amber oil.

Preparation of Intermediate III: [a(2,2,4-trimethyl-7-tert-octyl-6-chromanoxy)octanoyl chloride].

The purified carboxylic acid prepared above (101.1 g, 0.226 mol) was dissolved in dry dichloromethane (500 mL). Oxalyl chloride (57.8 mL, 0.678 mol) was added dropwise. The mixture was allowed to stir at room temperature for three hours under nitrogen. The dichloromethane and excess oxalyl chloride were removed by vacuum distillation. The resulting oil was triturated with dry toluene (50 mL), then vacuum distilled to yield the crude acid chloride as an amber oil, suitably pure for use in the subsequent reaction.

Preparation of Intermediate IV: 2-(3-oxo-4,4-dimethylvaleramido)-4-[a(2,2,4-trimethyl-7-tert-octyl-6-chromanoxy)octanamido]anisole.

The acid chloride prepared above (105.1 g, 0.226 mol) was taken up in acetonitrile (300 mL). A solution of 2-(3-oxo-4,4-dimethylvaleramido)-4-aminoanisole hydrochloride (67.98 g, 0.226 mol) in acetonitrile (75 mL) was added. To this suspension, triethylamine (31.5 mL, 0.226 mol) was slowly added. The reaction was stirred and heated to 50° C., then a second equivalent of triethylamine (31.5 mL, 0.226 mol) was slowly added. The reaction was stirred under nitrogen at 50° C. for 16 hours. The solvent was removed in vacuo. The resulting oil was taken up in ethyl acetate and washed with 0.1 N HCl and brine, then dried over magnesium sulfate. The product was recrystallized from pentane to yield 133.2 g of white crystals.

Preparation of Intermediate V: 2-(2-chloro-3-oxo-4,4-dimethylvaleramido)-4-[a(2,2,4-trimethyl-7-tert-octyl-6-chromanoxy)octanamido]anisole.

Intermediate IV (47.0 g, 0.0678 mol) was dissolved in dichloromethane (400 mL). A solution of sulfuryl chloride (5.5 mL, 0.068 mol) in dry dichloromethane (5 mL )was added to the flask dropwise. The reaction was stirred under nitrogen at room temperature for 2 hours. The solvent was removed in vacuo to yield 48.8 g of the product as a yellow oil.

Preparation of Yellow Coupler Y-5.

The 2-(2-chloro-3-oxo-4,4-dimethylvaleramido)-4-[a(2,2,4-trimethyl-7-tert-octyl-6-chromanoxy)octanamido] anisole (48.0 g, 0.0660 mol)and 5,5-dimethyloxazolidine-2,4-dione (9.37 g, 0.0726 mol) were dissolved in dry acetone (500 mL). Potassium carbonate (27.4 g, 0.198 mol) was added to the stirring solution. The reaction was heated to 50° C. and allowed to stir 8 hours. The acetone was removed in vacuo. The residue was redissolved in ethyl acetate and washed with 0.1 N HCl (3×50 mL), water (3×50 mL), and brine, then dried over magnesium sulfate. The solvent was removed in vacuo. The resulting oil was recrystallized from hot pentane to yield 51.4 g of product.

Mass spec: m/e 819; NMR ($CDCl_3$): d 0.8–2.2(57 H, m, alkyl); 2.8 (1 H, t, OCH); 3.8 (3 H, t,; $OCH_3$); 4.6 (1H, t, OC H-hex); 5.6 [1 h, s, C(O)—CH—C(O)]; 6.5–8.2; (5 H, aryl); 9.0 (1 H, s, NH). HPLC 99.8%

Example 1

Preparation of Photographic Elements

Dispersions of the couplers Y-1 to Y-12 and C-1 to C-6 were prepared in the following manner, exemplified with representative coupler Y-5: In one vessel, 1.57 g of the coupler, Y-5, 0.72 g of dibutyl phthalate, 0.6 g of 2-(2-butoxyethoxy)ethyl acetate and 4.6 g of ethylacetate were combined and warmed to 60° C. to dissolve. In a second vessel, 21.2 g of 11.55% gelatin, 2.44 g of Alkanol XC™ (surfactant and trademark of E. I. Dupont Co., USA) and 9.62 g of water were combined and warmed to 40° C. The two mixtures were combined and passed three times through a Gaulin colloid mill.

Comparative Coupler

C-1

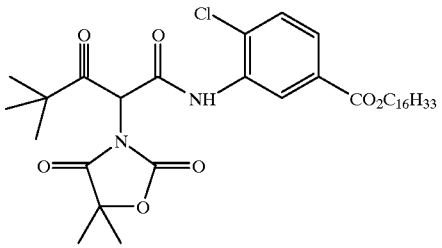

C-2

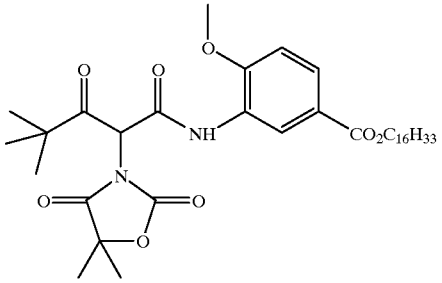

C-3

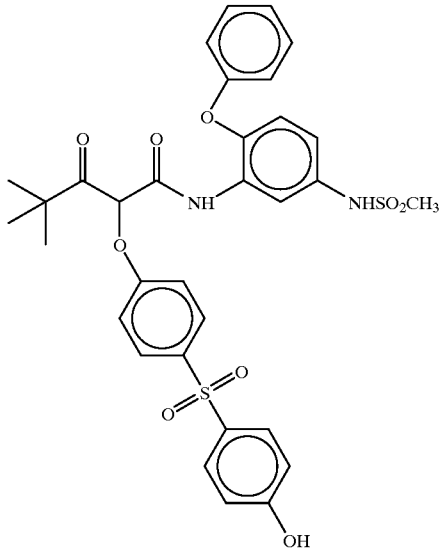

-continued
C-4
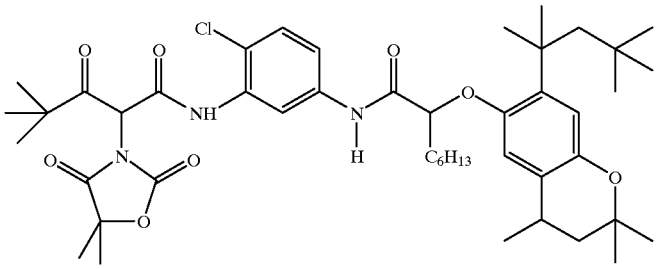
C-5
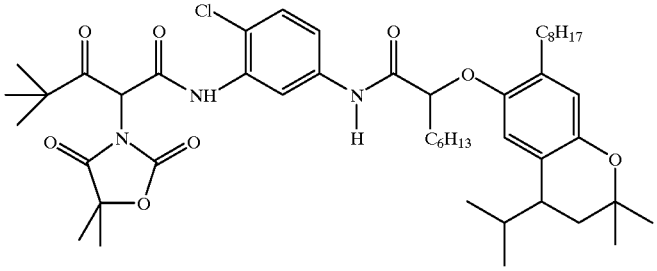
C-6
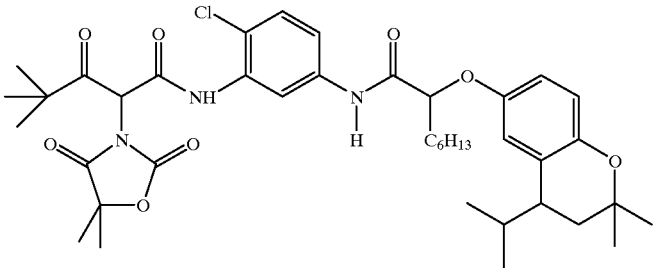
Yellow Coupler
Y-1
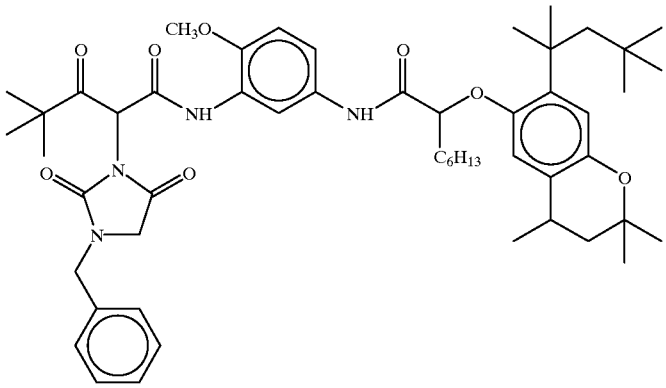
Y-2
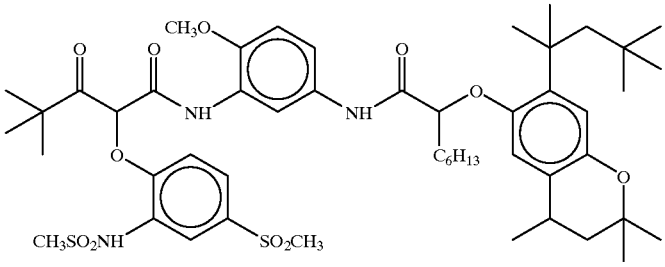

-continued
Y-3
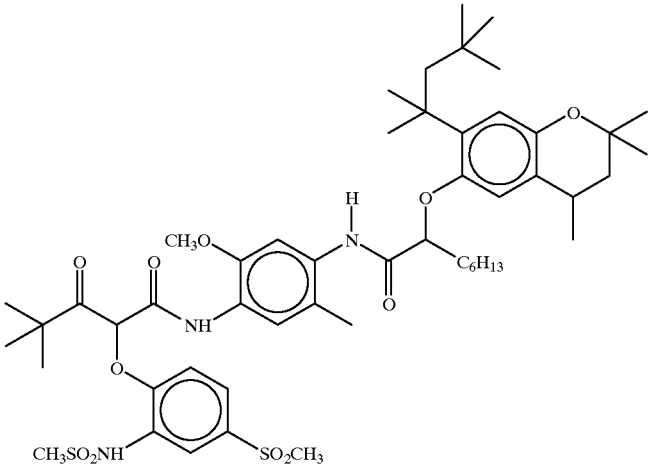
Y-3
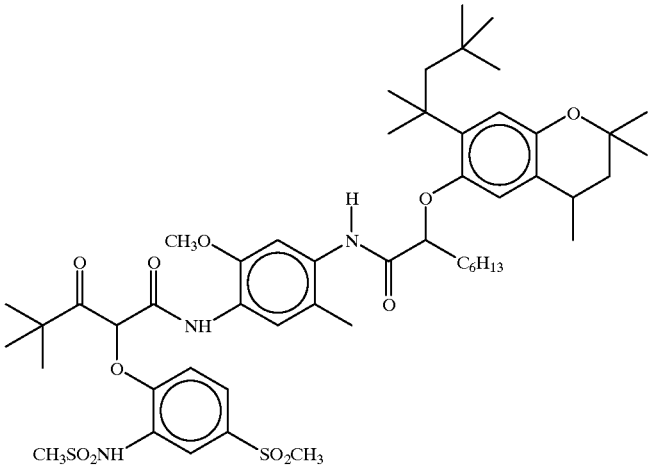
Y-4
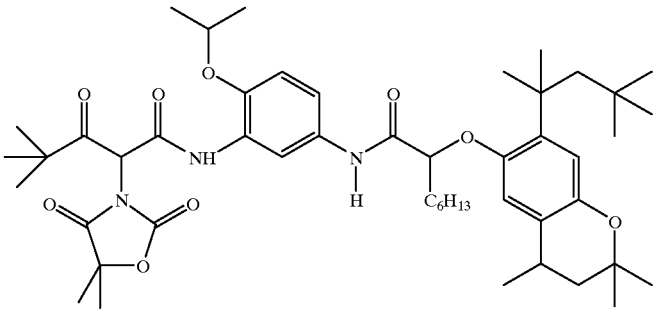
Y-5
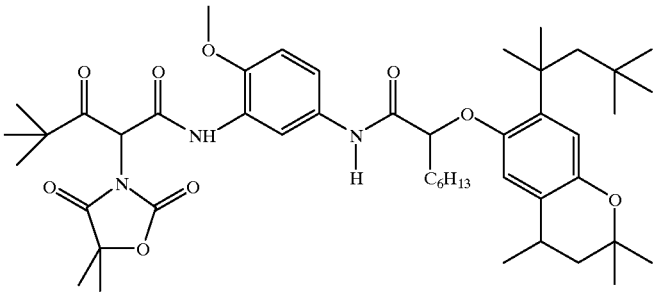

-continued
Y-6
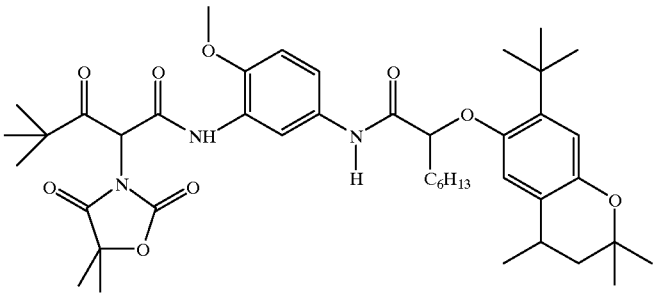
Y-7
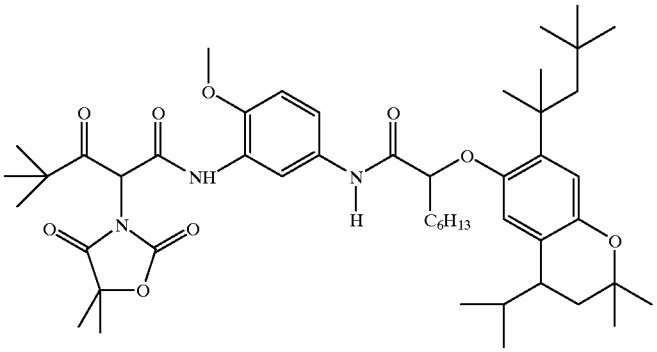
Y-8
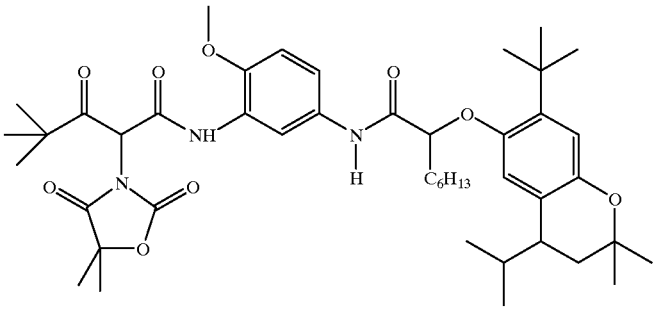
Y-9
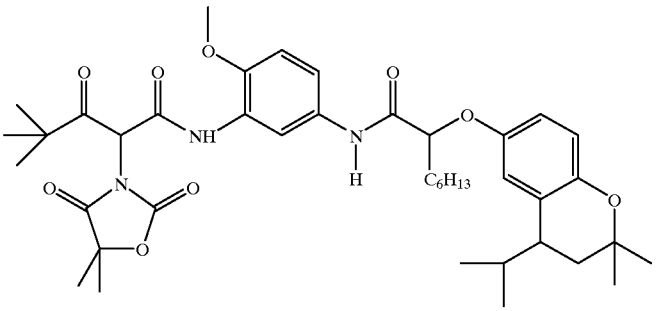

-continued

Y-10

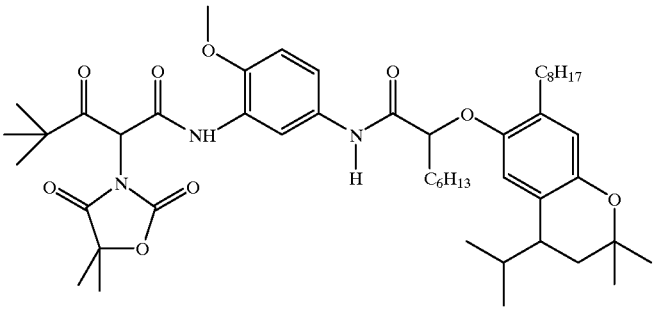

Y-11

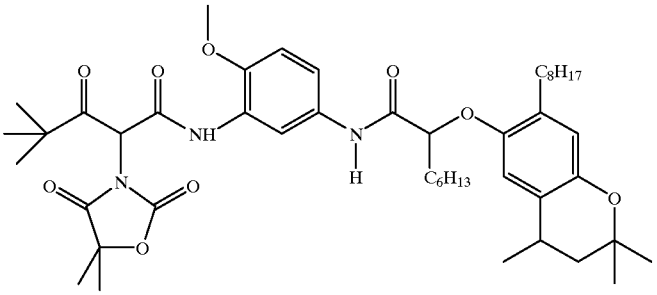

Y-12

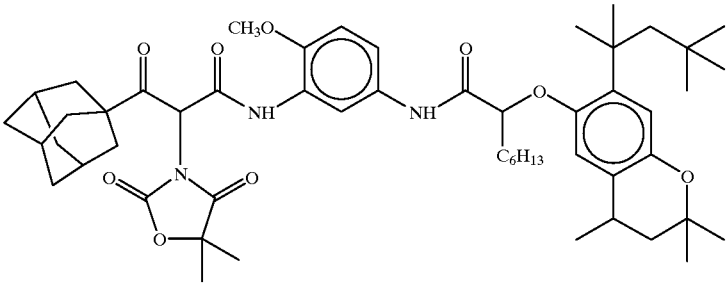

The photographic elements were prepared by coating the following layers in the order listed on a resin-coated paper support:

| | |
|---|---|
| 1st layer | |
| Gelatin | 3.23 g/m$^2$ |
| 2nd layer | |
| Coupler dispersion | 8.8 × 10$^{-4}$ mole coupling moieties/m$^2$ |
| AgCl emulsion | 0.28 g Ag/m$^2$ and blue-sensitized |
| 3rd layer | |
| Gelatin | 1.4 g/m$^2$ |
| Bis(vinylsulfonylmethyl)ether | 0.14 g/m$^2$ |

Exposing and Processing of Photographic Element

The photographic elements were subjected to stepwise exposure to blue light and processed as follows at 35° C.:

| | |
|---|---|
| Color Developer | 45 seconds |
| Bleach-Fix | 45 seconds |
| Wash (running water) | 90 seconds |

The developer and bleach-fix were of the following compositions:

| Developer | | |
|---|---|---|
| Water | 700 | mL |
| Triethanolamine | 12.41 | g |
| Blankophor REU TM (Mobay Corp) | 2.3 | g |
| Lithium polystyrene sulfonate (30%) | 0.3 | g |
| N,N-diethylhydroxylamine (85%) | 5.4 | g |
| Lithium sulfate | 2.7 | g |
| N-{2-[(4-amino-3-methylphenyl)ethylamino] ethyl}-methanesulfonamide, sesquisulfate | 5.0 | g |
| 1-hydroxyethyl-1,1-diphosphonic acid (60%) | 0.81 | g |
| Potassium carbonate, anhydrous | 21.16 | g |
| Potassium chloride | 1.6 | g |
| Potassium bromide | 7.0 | g |
| Water to make | 1.0 | L |
| pH at 26.7° C. adjusted to 10.2 | | |

-continued

| Bleach-Fix | |
|---|---|
| Water | 700 mL |
| Solution of Ammonium thiosulfate (56.4% plus Ammonium sulfite (4%) | 127.4 g |
| Sodium metabisulfite | 10.0 g |
| Acetic Acid (glacial) | 10.2 g |
| Solution of Ammonium ferric ethylene-diaminetetraacetate (44%) + ethylene-diaminetetraacetic acid (3.5%) | 110.4 g |
| Water to make | 1.0 L |
| pH at 26.7° C. adjusted to | 6.7 |

Photographic Tests

Yellow dyes were formed upon processing of the photographic elements. The coatings were assessed sensitometrically for the following characteristics: D-max (the maximum density to blue light), Dmin (the minimum density to blue light), Contrast (the ratio of (S-T)/0.6 where S is the density at a log exposure 0.3 units greater than the Speed value, and T is the density at a log exposure 0.3 units less than the Speed value), Speed (the relative reciprocal of exposure required to yield a density to blue light of 1.0), and Lambda-max (the wavelength of peak absorption at a density of 1.0). The data is reported in Table 1.

TABLE 1

Sensitometric Data

| Coupler | Dmax | Dmin | Contrast | 1 max |
|---|---|---|---|---|
| Y-1 | 2.8 | 0.07 | 2.5 | 439 |
| Y-2 | 2.9 | 0.06 | 2.7 | 439 |
| Y-3 | 2.9 | 0.06 | 2.8 | 436 |
| Y-4 | 2.5 | 0.09 | 2.7 | 437 |
| Y-5 | 2.8 | 0.05 | 3.0 | 438 |
| Y-6 | 2.5 | 0.05 | 3.0 | 439 |
| Y-7 | 2.5 | 0.06 | 2.8 | 436 |
| Y-8 | 2.6 | 0.05 | 3.0 | 438 |
| Y-9 | 2.6 | 0.08 | 2.9 | 439 |
| Y-10 | 2.7 | 0.07 | 2.9 | 437 |
| Y-11 | 2.8 | 0.07 | 3.0 | 439 |
| Y-12 | 2.6 | 0.08 | 2.8 | 439 |
| C-1 | 2.8 | 0.07 | 2.6 | 447 |
| C-2 | 2.8 | 0.07 | 2.7 | 437 |
| C-3 | 2.7 | 0.08 | 2.7 | 447 |
| C-4 | 2.6 | 0.05 | 2.7 | 447 |
| C-5 | 2.8 | 0.07 | 3.0 | 442 |
| C-6 | 2.7 | 0.08 | 3.0 | 445 |

Example 2

Light Stability Test

The coating strips were exposed to a high intensity Xenon light source at a luminous flux level of 50 Klux with a WRATTEN 2C filter interposed between the light source and sample. The strips were removed on a weekly basis and the decrease in density from initial densities of 1.7, 1.0 and 0.5 were measured. The data is recorded in Table 2 as a measure of the per cent dye retained for each sample dye. These results compare the light fastness of dyes from couplers of the present invention with those of the prior art. Table 3 compares data from invention and comparison couplers differing only in the ring 1 ortho substituent (ortho-chloro vs ortho-alkoxy). The superior light fastness of the ortho-alkoxy substituent is particularly apparent at long exposure times.

TABLE 2

Percent Dye Retained from Initial Reading of 1.0 after 4 Weeks at 50 Klux Exposure (normalized to internal checks)

| Coupler | Dye Retained |
|---|---|
| Y-1 | 78% |
| Y-2 | 79% |
| Y-3 | 78% |
| Y-4 | 83% |
| Y-5 | 77% |
| Y-6 | 75% |
| Y-7 | 79% |
| Y-8 | 79% |
| Y-9 | 70% |
| Y-10 | 70% |
| Y-11 | 70% |
| Y-12 | 87% |
| C-1 | 17% |
| C-2 | 26% |
| C-3 | 38% |
| C-4 | 62% |
| C-5 | 65% |
| C-6 | 65% |

TABLE 3

Direct comparison of ortho-alkoxy vs ortho-chloro Pairs

| Coupler | ortho substituent | 4 weeks @ 50 Klux Dye retained | 5 weeks @ 50 Klux Dye retained |
|---|---|---|---|
| Y-5 | OCH3 | 77% | 70% |
| C-4 | Cl | 62% | 44% |
| Y-9 | OCH3 | 70% | 60% |
| C-6 | Cl | 65% | 50% |
| Y-10 | OCH3 | 70% | 68% |
| C-5 | Cl | 65% | 44% |

As can be seen from Table 2, the couplers of the invention have superior light fastness as compared to couplers typically used in the art. They are stable enough to be used without light stabilizing addenda when desiring a neutral fade position with typical magenta and cyan dyes.

Example 3

Neutral fade can also be achieved even if extremely stable magenta and cyan dyes are utilized by incorporating light stabilizing addenda along with the yellow couplers of this invention. Photographic samples were prepared in an analogous photographic format to that described above with the following weight ratios: Yellow coupler:dibutylphthalate:2-(2-butoxyethoxy) ethylacetate: Compound 1 54:15:18:13. Table 4 describes 4-week light fade data for dyes formed from representative couplers using Compound 1 as addenda.

Compound 1
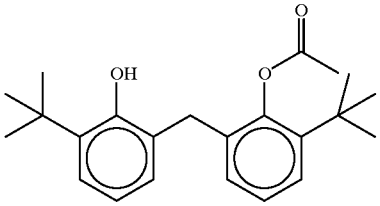
Compound 2
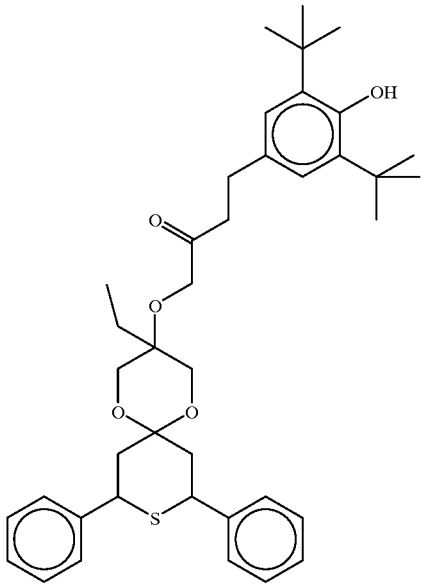
Compound 3
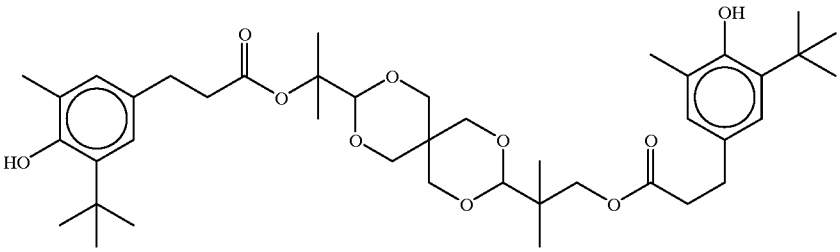
P1
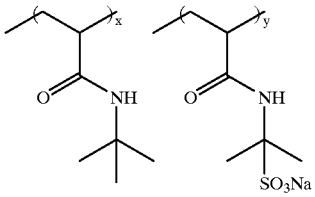

Data Table 4. Dye Retained from Initial Density 1.0, 50 Klux HID Coupler +/− Compound 1

| Coupler | No addenda | Coupler + compound 1 |
|---|---|---|
| Y-1* | 78% | 85% |
| Y-2* | 79% | 93% |
| Y-3* | 78% | 89% |
| C-1 | 17% | 69% |

*Invention Couplers

The invention has been described in detail with particular reference to certain preferred embodiments thereof, but it will be understood that variations and modifications can be effected within the spirit and scope of the invention.

What is claimed is:

1. A photographic element comprising a silver halide emulsion layer having associated therewith a yellow dye-forming coupler which is an acylacetanilide compound comprising an alkoxy or aryloxy substituent ortho to the nitrogen atom on the acetanilide ring said ring further comprising a substituent containing a chroman ether group.

2. The element of claim 1 wherein the coupler has formula (I):

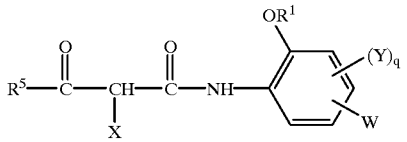

wherein Y is a substituent; q is 0 or 1; W is a substituent containing a chroman ether group, X is hydrogen or a coupling-off group, $R^5$ is a substituent, and $R^1$ is an alkyl or aryl group.

3. The element of claim 2 wherein $R^1$ is an alkyl group.

4. The element of claim 3 wherein $R^1$ is an alkyl group having 1 to 10 carbon atoms.

5. The element of claim 4 wherein $R^1$ is an alkyl group branched at the alpha carbon.

6. The element of claim 2 wherein the chroman ether group contains a substituent on the phenyl ring.

7. The element of claim 6 wherein the substituent on the phenyl ring of the chroman ether group is an alkyl group having 1 to 10 carbon atoms.

8. The element of claim 6 wherein the substituent on the phenyl ring of the chroman ether group is an alkyl group branched at the alpha carbon of the substituent.

9. The element of claim 2 wherein W has the formula:

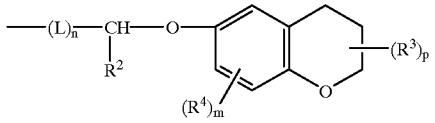

wherein $R^2$ is a substituent, $R^4$ is a substituent with m being 0 to 3, $R^3$ is alkyl, aryl, or hydrogen, with p being 0 to 3, and L is a divalent linking group with n being 0 to 3.

10. The element of claim 9 wherein L is

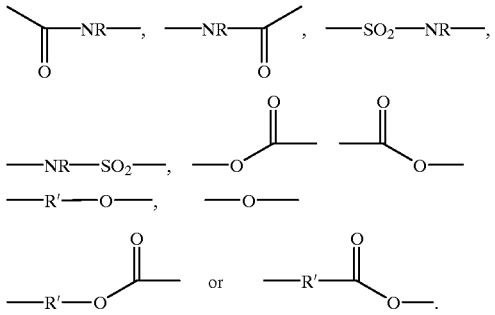

11. The element of claim 9 wherein L is an aminocarbonyl, acylamino, acyloxy, or oxycarbonyl group.

12. The element of claim 2 wherein the silver halide emulsion layer contains less than 0.5 moles of coupler stabilizer per mole of coupler.

13. The element of claim 2 wherein the silver halide emulsion layer is greater than 90 mole % silver chloride.

14. The element of claim 2 wherein $R^5$ is adamantyl.

15. A photographic element compising a silver halide emulsion layer having associated therewith a yellow dye-forming coupler represented by the following formula

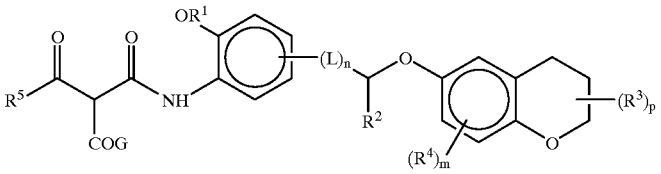

wherein $R^1$ is an alkyl or alkyl group, $R^2$ is a substituent, $R^4$ is a substituent with m being 0 to 3, $R^3$ is alkyl, aryl, or hydrogen, with p being 0 to 3, $R^5$ is a substituent, COG is a coupling off groups and L is a divalent linking group with n being 0 to 3, wherein at least one of $R^1$, $R^3$ and $R^4$ is an alkyl group branched at the alpha carbon.

16. The element of claim 15 wherein $R^1$ is an alkyl group.

17. The element of claim 16 wherein $R^1$ is an alkyl group having 1 to 10 carbon atoms.

18. The element of claim 15 wherein $R^2$ is an alkyl, alkoxy or aryl group.

19. The element of claim 15 wherein $R^2$ is an alkyl group having 1 to 12 carbon atoms.

20. The element of claim 15 wherein $R^5$ is an alkyl, or aryl group.

21. The element of claim 20 wherein $R^5$ is an alkyl group.

22. The element of claim 21 wherein $R^5$ is an adamantyl group.

23. The element of claim 15 wherein at least two of $R^1$, $R^3$ and $R^4$ is an alkyl group branched at the alpha carbon.

24. The element of claim 15 wherein the silver halide emulsion layer is greater than 90 mole % silver chloride.

25. The element of claim 15 wherein the silver halide emulsion layer contains less than 0.5 moles of coupler stabilizer per mole of coupler.

26. The element of claim 15 wherein $R^1$ is an alkyl group, $R^2$ is an alkyl, alkoxy or aryl group and $R^5$ is an alkyl or aryl group.

27. The element of claim 23 wherein $R^1$ is an alkyl group, $R^2$ is an alkyl, alkoxy or aryl group and $R^5$ is an alkyl or aryl group.

28. The element of claim 15 wherein $R^4$ is an alkyl, alkoxy, dialkylamino or alkylthio group.

29. The element of claim 15 wherein $R^1$, $R^2$, $R^3$, and $R^4$ are independently alkyl groups having 1 to 10 carbon atoms and $R^5$ is an alkyl or aryl group.

30. The element of claim 23 wherein $R^1$ $R^2$, $R^3$, and $R^4$ are independently alkyl groups having 1 to 10 carbon atoms and $R^5$ is an alkyl or aryl group.

31. The element of claim 15 wherein the silver halide emulsion layer also contains a stabilizing addenda represented by the following Compound 1

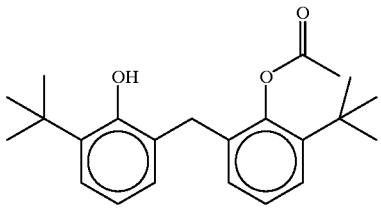

Compound 2

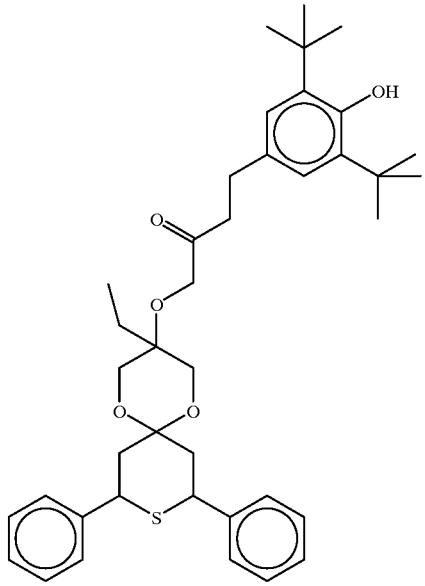

Compound 3

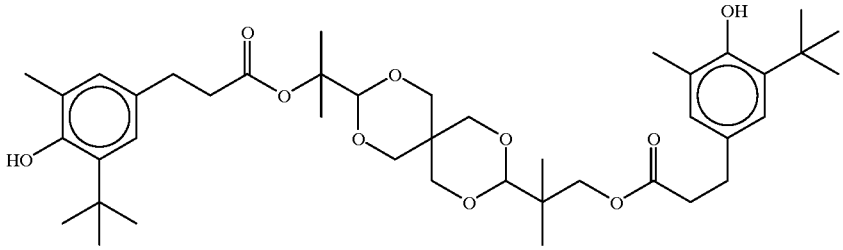

or a polymeric stabilizing addenda containing monomers derived from styrene, acrylates, methacrylamides, or maethacrylates.

* * * * *